US010795293B2

(12) United States Patent
Utsunomiya et al.

(10) Patent No.: US 10,795,293 B2
(45) Date of Patent: Oct. 6, 2020

(54) FIXING DEVICE AND IMAGE FORMING APPARATUS INCORPORATING SAME

(71) Applicants: Kohichi Utsunomiya, Kanagawa (JP); Yutaka Ikebuchi, Kanagawa (JP)

(72) Inventors: Kohichi Utsunomiya, Kanagawa (JP); Yutaka Ikebuchi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/690,236

(22) Filed: Nov. 21, 2019

(65) Prior Publication Data

US 2020/0159151 A1 May 21, 2020

(30) Foreign Application Priority Data

Nov. 21, 2018 (JP) ..... 2018-218217

(51) Int. Cl.
*G03G 15/20* (2006.01)

(52) U.S. Cl.
CPC ..... *G03G 15/2053* (2013.01)

(58) Field of Classification Search
CPC ..... G03G 15/2053
See application file for complete search history.

(56) References Cited

U.S. PATENT DOCUMENTS 9,606,483 B2 * 3/2017 Ishida ..... G03G 15/2053
2013/0188991 A1 * 7/2013 Kawata ..... G03G 15/2053 399/122
2015/0078793 A1 * 3/2015 Takahashi ..... G03G 15/2053 399/329
2015/0293482 A1 * 10/2015 Takahashi ..... G03G 15/2053 399/329
2016/0252856 A1 * 9/2016 Suzuki ..... G03G 15/2053 399/329
2016/0266529 A1 * 9/2016 Ishida ..... G03G 15/2053
2016/0274519 A1 * 9/2016 Lim ..... G03G 15/2053
2016/0327891 A1 11/2016 Ikebuchi et al.
2017/0102652 A1 4/2017 Imada et al.
2019/0121271 A1 4/2019 Hase et al.

FOREIGN PATENT DOCUMENTS

JP 2012-123313 6/2012
JP 2015-146052 8/2015
JP 2017-215434 12/2017

OTHER PUBLICATIONS

Machine translation of JP 2017-215434 A (published on Dec. 7, 2017) printed on Mar. 18, 2020.*

* cited by examiner

*Primary Examiner* — Sophia S Chen
(74) *Attorney, Agent, or Firm* — Harness, Dickey & Pierce, P.L.C.

(57) ABSTRACT

A fixing device includes a fixing rotator, a heat source, a pressing member, a nip formation member, a reflector, and a support. The heat source is configured to heat the fixing rotator. The pressing member is configured to form a nip with the fixing rotator. The nip formation member is disposed inside a loop of the fixing rotator and opposed to the pressing member to form the nip between the fixing rotator and the pressing member. The reflector is configured to reflect heat from the heat source. The support is configured to secure the reflector. The support is in contact with the reflector at at least one end portion in a longitudinal direction of the support.

20 Claims, 12 Drawing Sheets

FIXING DEVICE AND IMAGE FORMING APPARATUS INCORPORATING SAME

CROSS-REFERENCE TO RELATED APPLICATION

This patent application is based on and claims priority pursuant to 35 U.S.C. § 119(a) to Japanese Patent Application No. 2018-218217, filed on Nov. 21, 2018, in the Japan Patent Office, the entire disclosure of which is hereby incorporated by reference herein.

BACKGROUND

Technical Field

Embodiments of the present disclosure generally relate to a fixing device and an image forming apparatus incorporating the fixing device.

Discussion of the Background Art

For a fixing device using a light-emitting heat source, there is known a technique that uses a reflector to make maximum use of heat. For example, there is known a technology that includes an endless belt, a reflector to reflect radiant heat from a heater, and a stay to support the reflector and fastens the reflector and the stay with a fastening member.

SUMMARY

In an aspect of the present disclosure, there is provided a fixing device that includes a fixing rotator, a heat source, a pressing member, a nip formation member, a reflector, and a support. The heat source is configured to heat the fixing rotator. The pressing member is configured to form a nip with the fixing rotator. The nip formation member is disposed inside a loop of the fixing rotator and opposed to the pressing member to form the nip between the fixing rotator and the pressing member. The reflector is configured to reflect heat from the heat source. The support is configured to secure the reflector. The support is in contact with the reflector at at least one end portion in a longitudinal direction of the support.

In another aspect of the present disclosure, there is provided an image forming apparatus including the fixing device.

BRIEF DESCRIPTION OF THE DRAWINGS

A more complete appreciation of the disclosure and many of the attendant advantages and features thereof can be readily obtained and understood from the following detailed description with reference to the accompanying drawings, wherein:

FIGS. 5Ab and 5Ac are enlarged views of the configuration of the fixing device illustrated in FIG. 5Aa;

FIG. 6Ab is an enlarged view of the configuration the fixing device illustrated in FIG. 6Aa;

FIG. 6Bb is a plan view of the fixing device illustrated in FIG. 6Aa, illustrating another arrangement relationship between the reflector and the support;

FIGS. 7Ab and 7Ac are enlarged views of the configuration of the fixing device illustrated in FIG. 6Aa;

FIGS. 8Ab and 8Ac are enlarged views of the configuration of the fixing device illustrated in FIG. 8Aa;

Figure 1:
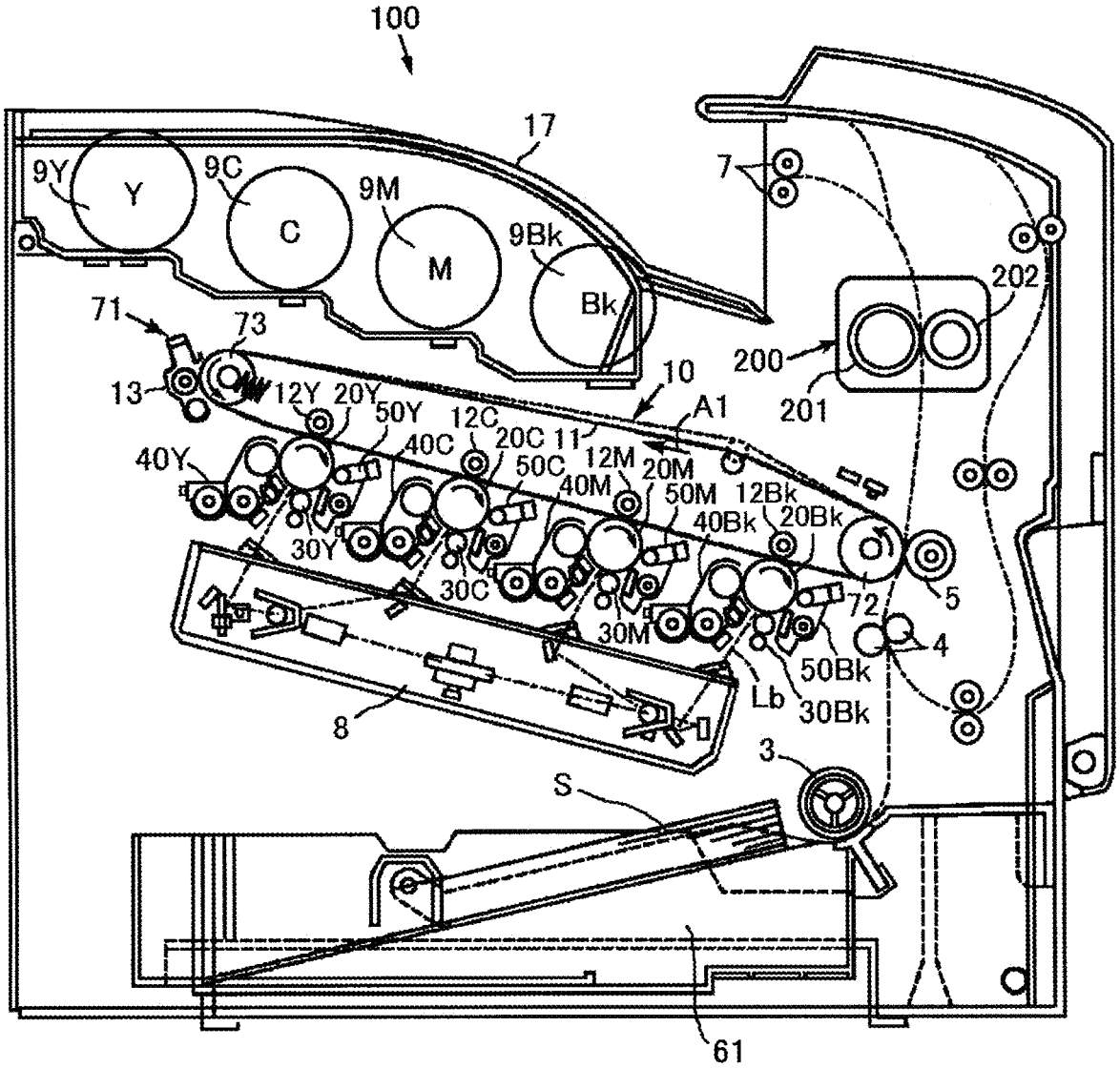
FIG. 1 is a diagram of an image forming apparatus including a fixing device according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present disclosure. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Hereinafter, a fixing device and an image forming apparatus according to embodiments of the present disclosure are described with reference to the accompanying drawings. First, an example of an image forming apparatus including a fixing device according to an embodiment of the present disclosure is described with reference to FIG. 1. Using the fixing device described below can provide an image forming apparatus with high productivity. In FIG. 1, an image forming apparatus 100 according to the present embodiment is illustrated as a color printer employing a tandem system in which a plurality of image forming devices to form toner images in a plurality of colors, respectively, is aligned in a stretch direction of a transfer belt. Alternatively, in some embodiments, the image forming apparatus 100 may be a copier, a facsimile machine, a printer, a multifunction peripheral or a multifunction printer (MFP) having at least one of copying, printing, scanning, facsimile, and plotter functions, or the like.

The image forming apparatus 100 employs a tandem structure in which four photoconductive drums 20Y, 20C, 20M, and 20Bk serving as image bearers that bear yellow, cyan, magenta, and black toner images in separation colors, respectively, are arranged side by side. The yellow, cyan, magenta, and black toner images formed on the photoconductive drums 20Y, 20C, 20M, and 20Bk, respectively, are primarily transferred successively onto an endless transfer belt 11 serving as an intermediate transferor disposed opposite the photoconductive drums 20Y, 20C, 20M, and 20Bk as the transfer belt 11 rotates in a rotation direction A1 such that the yellow, cyan, magenta, and black toner images are superimposed on a same position on the transfer belt 11 in a primary transfer process. Thereafter, the yellow, cyan, magenta, and black toner images superimposed on the transfer belt 11 are secondarily transferred onto a recording medium S (e.g., a recording sheet and a transfer sheet) collectively in a secondary transfer process.

Each of the photoconductive drums 20Y, 20C, 20M, and 20Bk is surrounded by image forming components that form the yellow, cyan, magenta, and black toner images on the photoconductive drums 20Y, 20C, 20M, and 20Bk as the photoconductive drums 20Y, 20C, 20M, and 20Bk rotate clockwise in FIG. 1. Taking the photoconductive drum 20Bk that forms the black toner image, the following describes an image forming operation to form the black toner image. The photoconductive drum 20Bk is surrounded by a charger 30Bk, a developing device 40Bk, a primary transfer roller 12Bk, and a cleaner 50Bk in this order in a rotation direction of the photoconductive drum 20Bk. The photoconductive drums 20Y, 20C, and 20M are also surrounded by chargers 30Y, 30C, and 30M, developing devices 40Y, 40C, and 40M, primary transfer rollers 12Y, 12C, and 12M, and cleaners 50Y, 50C, and 50M in this order in the rotation direction of the photoconductive drums 20Y, 20C, and 20M, respectively. After the charger 30Bk charges the photoconductive drum 20Bk, an optical writing device 8 writes an electrostatic latent image on the photoconductive drum 20Bk.

As the transfer belt 11 rotates in the rotation direction A1, the yellow, cyan, magenta, and black toner images formed as visible images on the photoconductive drums 20Y, 20C, 20M, and 2OBk, respectively, are primarily transferred successively onto the transfer belt 11 such that the yellow, cyan, magenta, and black toner images are superimposed at the same position on the transfer belt 11. Specifically, the primary transfer rollers 12Y, 12C, 12M, and 12Bk disposed opposite the photoconductive drums 20Y, 20C, 20M, and 20Bk, respectively, via the transfer belt 11 are supplied with electric voltage to transfer the yellow, cyan, magenta, and black toner images at different times onto the transfer belt 11 from the photoconductive drums 20Y 20C, 20M, and 2013*k* in this order. Note that the photoconductive drum 20Y is an upstream photoconductor and the photoconductive drum 20Bk is a downstream photoconductor in the rotation direction A1 of the transfer belt 11. The photoconductive drums 20Y, 20C, 20M, and 20Bk are aligned in this order in the rotation direction A1 of the transfer belt 11. The photoconductive drums 20Y, 20C, 20M, and 20Bk are located in four image forming stations that form the yellow, cyan, magenta, and black toner images, respectively.

The image forming apparatus 100 includes the four image forming stations, a transfer belt unit 10, a secondary transfer roller 5, a cleaning device 13, and the optical writing device 8. The transfer belt unit 10 is situated above and disposed opposite the photoconductive drums 20Y, 20C, 20M, and 20Bk. The transfer belt unit 10 incorporates the transfer belt 11 and the primary transfer rollers 12Y, 12C, 12M, and 12Bk. The secondary transfer roller 5 serves as a transferor disposed opposite the transfer belt 11 and driven and rotated in accordance with rotation of the transfer belt 11. The cleaning device 13 is disposed opposite the transfer belt 11 to clean the transfer belt 11. The optical writing device 8 is situated below and disposed opposite the four image forming stations.

The optical writing device 8 includes a semiconductor laser as a light source, a coupling lens, an fθ lens, a toroidal lens, a folding mirror, a rotating polygon mirror as a deflector, and the like. The optical writing device 8 emits writing light Lb corresponding to each color to each of the photoconductive drums 20Y 20C, 20M, and 20Bk to form an electrostatic latent image on each of the photoconductive drums 20Y, 20C, 20M, and 20Bk. In FIG. 1, for the sake of convenience, the writing light Lb is labeled only for the black image station, but the same applies to the other image stations.

The image forming apparatus 100 includes a sheet feeding device 61, a registration roller pair 4, and a sensor. The sheet feeding device 61 is a sheet feeding cassette loaded with a recording material S fed between the secondary transfer roller 5 and the transfer belt 11. The registration roller pair 4 feeds the recording material S, which has been transported from the sheet feeding device 61, toward a transfer portion between the secondary transfer roller 5 and the transfer belt 11 at a predetermined timing in accordance with toner image formation timing by the image stations. The sensor detects an arrival of the leading end of the recording material S at the registration roller pair 4.

The image forming apparatus 100 also includes a fixing device 200, sheet ejection rollers 7, a sheet ejection tray 17, and toner bottles 9Y, 9C, 9M, and 9Bk. The fixing device 200 fixes the toner image on the recording material S to which the toner image has been transferred. The sheet ejection rollers 7 eject the recording material S, on which the toner image has been fixed, to the outside of a body of the image forming apparatus 100. The sheet ejection tray 17 is disposed on the top of the body of the image forming apparatus 100, and the recording material S ejected from the body of the image forming apparatus 100 by the sheet ejection rollers 7 is stacked on the sheet ejection tray 17. The toner bottles 9Y, 9C, 9M, and 9Bk are filled with toners of yellow, cyan, magenta, and black, respectively. The transfer belt unit 10 includes a drive roller 72 and a driven roller 73 around which the transfer belt 11 is wound, in addition to the transfer belt 11 and the primary transfer rollers 12Y, 12C, 12M, and 12Bk.

The driven roller 73 also has a function as a tension urging member for the transfer belt 11. For such a function, the driven roller 73 includes an urging member using a spring or the like. A transfer device 71 includes the transfer belt unit 10, the primary transfer rollers 12Y, 12C, 12M, and 12Bk, the secondary transfer roller 5, and the cleaning device 13. The sheet feeding device 61 is disposed at a lower part of the body of the image forming apparatus 100 and includes a feeding roller 3 to contact an upper surface of an uppermost recording material S. The feeding roller 3 is driven to rotate counterclockwise in FIG. 1 to feed the uppermost recording material S toward the registration roller pair 4.

The cleaning device 13 in the transfer device 71 has a cleaning brush and a cleaning blade disposed so as to face and contact the transfer belt 11. The transfer belt 11 is cleaned by scraping and removing foreign matters such as residual toner on the transfer belt 11 with the cleaning brush and the cleaning blade. The cleaning device 13 further includes a waste toner discharger that delivers and discards residual toner removed from the transfer belt 11.

Figure 2:
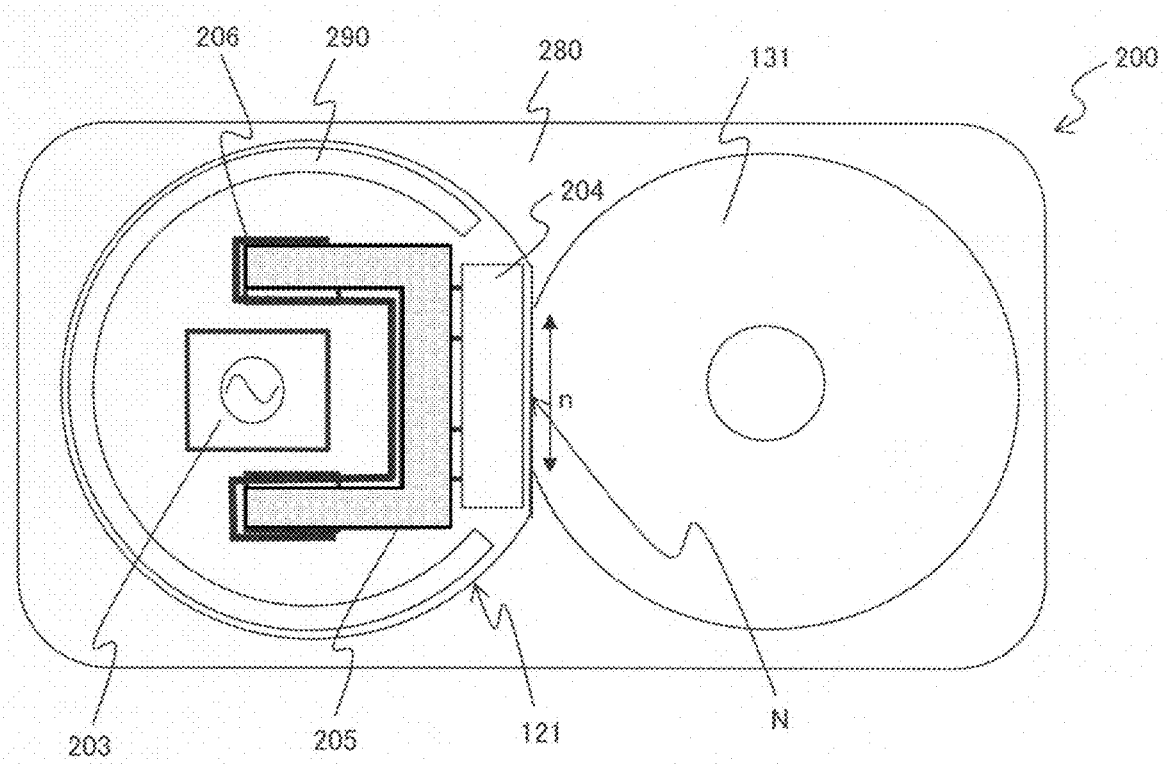
FIG. 2 is a cross-sectional view of a configuration of the fixing device illustrated in FIG. 1.

FIG. 2 is a cross-sectional configuration diagram of the fixing device 200 of FIG. 1, including roller 201 and pressure roller 202. The fixing device 200 in the present embodiment includes a pressure roller 131 as a pressing member or rotator and a fixing belt 121 as a fixing member or rotator. The fixing belt 121 is directly heated by radiation heat from the inner peripheral side by a halogen heater 203 as a heat source. The fixing device 200 further includes a temperature sensor that faces an outer peripheral surface of the fixing belt 121 and detects the temperature of the fixing belt 121. In a loop of the fixing belt 121 (inside the fixing member), a nip formation pad 204 as a nip formation member is pressed against the pressure roller 131, which is opposed to the nip formation pad 204, via the fixing belt 121 to form a nip portion N. The nip formation pad 204 slide directly or indirectly via a slide sheet over the inner surface of the fixing belt 121. In FIG. 2, the nip portion N has a flat shape with a nip width n. In some embodiments, the nip portion N may have a recessed shape or other shape. If the nip portion N has a recessed shape, the recessed nip portion N directs the leading edge of the recording medium S toward the pressure roller 202 as the recording medium S is ejected from the nip portion N, facilitating separation of the recording material S from the fixing belt 121 and reducing jamming of the recording material S.

The fixing belt 121 is an endless belt or film made of a metal material, such as nickel or stainless steel (e.g., steel use stainless or SUS), or a resin material such as polyimide. The fixing belt 121 includes a base layer and a release layer. The release layer constituting an outer surface layer is made of PFA, PTFE, or the like to facilitate separation of toner of a toner image on the recording material S from the fixing belt 121, thus preventing the toner of the toner image from adhering to the fixing belt 121. An elastic layer may be sandwiched between the base layer and the release layer made of e.g., PFA or PTFE, and may be made of silicone rubber or the like. Omitting the elastic layer made of silicone rubber reduces heat capacity and enhances fixability. However, the slight surface roughness of the fixing belt 121 may be transferred onto a recording material while a toner image is fixed onto the recording material, causing an orange-peel image, which is an image having uneven gloss in a solid part of the image. To address this circumstance, the elastic layer made of silicone rubber has a thickness not smaller than 100 micrometers (μm). As the elastic layer made of, e.g., silicone rubber deforms, the elastic layer absorbs the slight surface roughness in the fixing belt 121, thereby reducing formation of the faulty orange-peel image.

The fixing belt 121 is provided with a support 205 (stay) to secure and support the nip formation pad 204 and the reflector 206. The support 205 prevents bending of the nip formation pad 204 that receives pressure by the pressure roller 131, thus obtaining a uniform nip width in the axial direction of the support 205. The support 205 is held, secured, and positioned at flanges as holders at both ends of the support 205 in the axial direction. A reflector 206 is disposed between the heat source 203 and the support 205, to reduce wasteful energy consumption due to the support 205 being heated by, e.g., radiation heat from the heat source 203. Here, the same effect can be obtained even if the surface of the support 205 is heat-insulated or mirror-finished instead of including the reflector 206. The heat source 203 may be the halogen heater illustrated in FIG. 2 bud may be an induction heating device, a resistance heating element, a carbon heater, or the like.

The pressure roller 131 includes an elastic rubber layer on a core metal. A release layer (PFA or PTFE layer) is disposed on the outer surface of the pressure roller 131 in order to obtain releasability. A driving force is transmitted to the pressure roller 131 through gears from a drive source, such as a motor, provided in the image forming apparatus 100, to rotate the pressure roller 131. The pressure roller 131 is pressed against the fixing belt 121 by a spring or the like, and the elastic rubber layer is compressed and deformed so that the nip portion N has a predetermined nip width n. The pressure roller 131 may be a hollow roller. Alternatively, the pressure roller 131 may include a heat source such as a halogen heater. The elastic rubber layer may be solid rubber. If there is no heat source such as a heater inside the pressure roller 131, sponge rubber may be used. In such a case, the sponge rubber is more preferable than the solid rubber since the sponge rubber has an increased heat insulation that draws less heat from the fixing belt 121.

The fixing belt 121 is entrained (driven) and rotated by the pressure roller 131. In the present embodiment, the pressure roller 131 is rotated by a driving source and the driving force is transmitted to the fixing belt 121 at the nip portion N, thus rotating the fixing belt 121. The fixing belt 121 is sandwiched and rotated at the nip portion N, and travels while being guided by holders (flanges) at both ends in other portions than the nip portion. With the construction described above, the fixing device 200 attaining quick warm-up is manufactured at reduced costs.

As illustrated in FIG. 2, the heat generated from the heat source 203 is reflected by the reflector 206. However, a part of the heat remains on the reflector 206 and is transmitted to the support 205, which is a stay, which might cause a failure such as melting of the pad due to temperature rise.

Figure 3A:
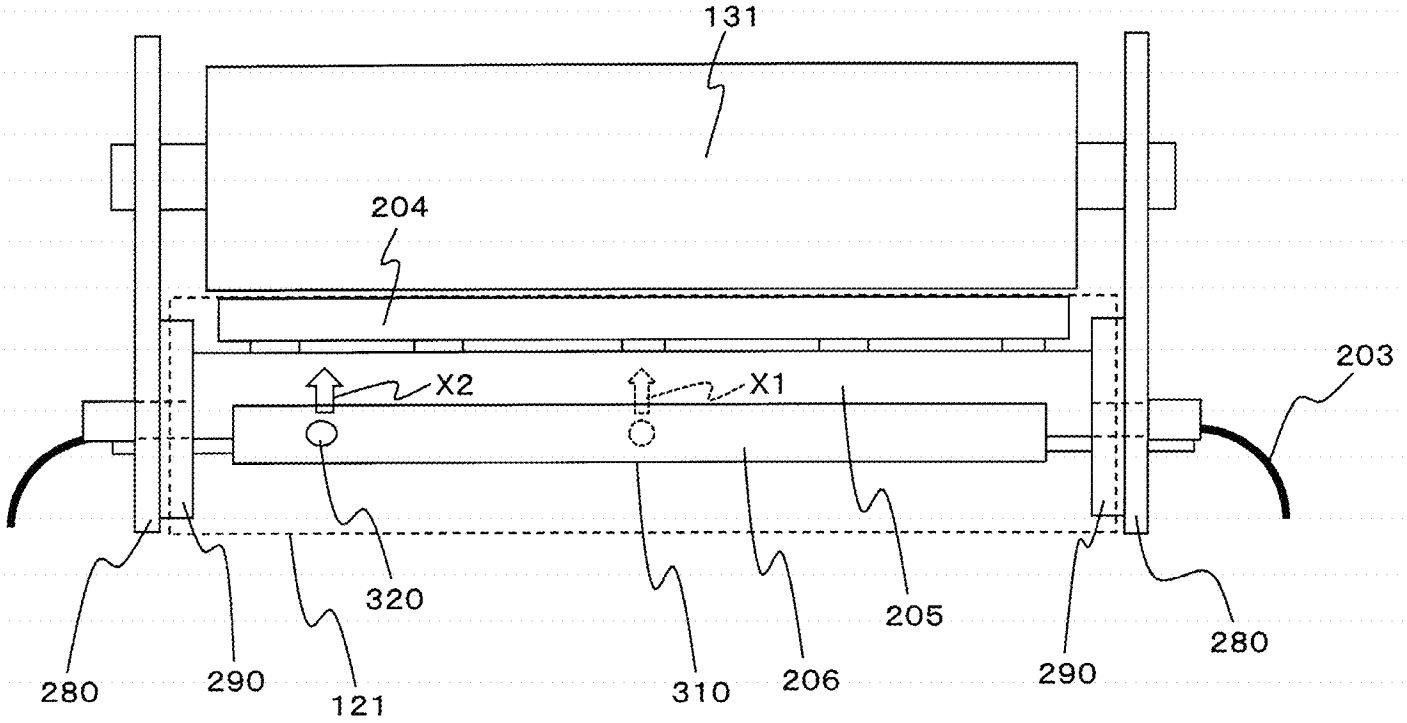
FIG. 3A is a plan view of the fixing device illustrated in FIG. 2.
Figure 3B:
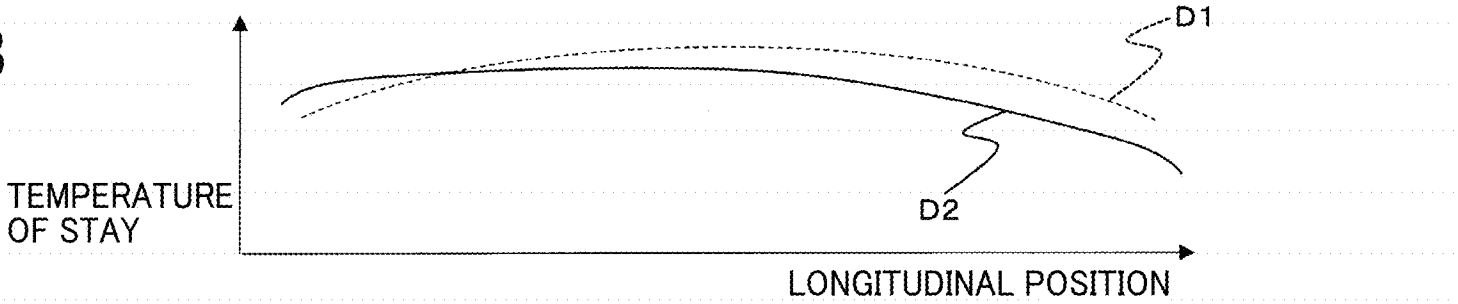
FIG. 3B is a diagram of a temperature distribution of a support in the fixing device.

FIG. 3A is a plan view of the fixing device illustrated in FIG. 2. FIG. 3B is a diagram of a temperature distribution of the support. Conventionally, the reflector 206 and the support 205 are screwed at a securing portion 310 indicated by a dotted line in FIG. 3A. Accordingly, heat is transmitted from the reflector 206 to the support 205 at a longitudinal center of the reflector 206 or the support 205, and the transmitted heat increases the temperature of the support 205 itself or the nip formation pad 204. Since both ends of the support 205 abut the side plates 280 via the holders 290, the heat can be released. The temperature distribution of the support 205 at this time forms a distribution D1 indicated by a dotted line in FIG. 3B in which the temperature of a longitudinal central portion is relatively high and the temperatures of longitudinal end portions are relatively low. The longitudinal central portion and each longitudinal end portion are, for example, a center part and each end part obtained when the support 205 is equally divided into three parts in the longitudinal directions.

On the other hand, when the reflector 206 and the support 205 are screwed at a securing portion 320 indicated by a solid line in FIG. 3A, the heat transfer from the reflector 206 to the support 205 has a distribution D2 indicated by a solid line in FIG. 3B That is, as indicated by dotted line arrow X1 in FIG. 3A, the screwed position is shifted from the longitudinal central portion toward the longitudinal end portion as indicated by solid line arrow X2 in FIG. 3A. Accordingly, heat transmitted from the reflector 206 to the support 205 can be easily released to the side plates 280, allowing the peak temperature of the support 205 to be lowered. As described above, the reflector 206 and the support 205 are brought into contact with each other at the longitudinal end portions where heat is unlikely to accumulate, or are secured so as to increase the contact area, thus efficiently releasing the heat of the reflector 206 and reducing the temperature of reflector 206. Further, the configuration in which the reflector and the support member are screwed can withstand high temperatures and reduce an increase in the temperature of the reflector without contacting even in a narrow gap.

Figure 4A:
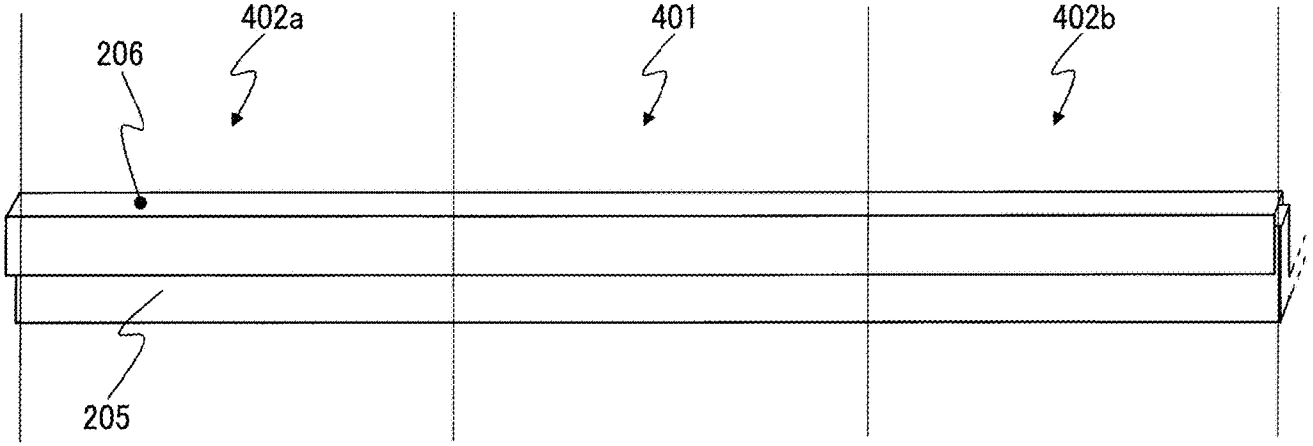
FIG. 4A is a plan view of a reflector and the support of the fixing device.
Figure 4B:
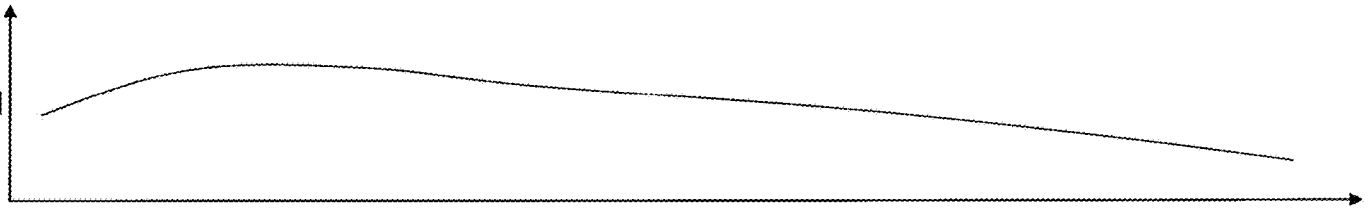
FIGS. 4B and 4C are graphs representing that the flow rate of heat from the reflector to the support is larger at positions closer to end portions than a central portion in a longitudinal direction of the reflector or the support.
Figure 4C:
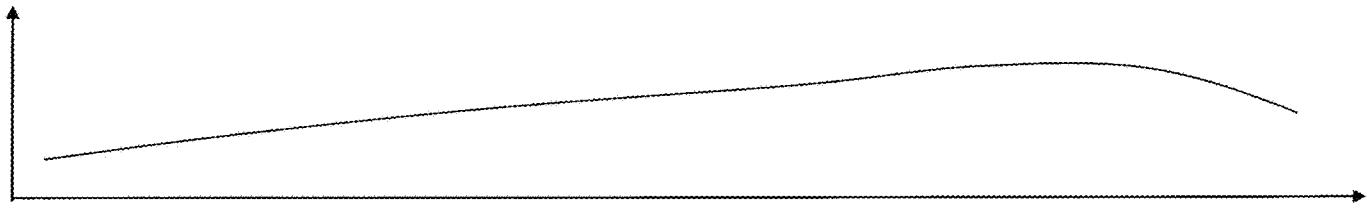

FIGS. 4A to 4C represent that the flow rate of heat from the reflector 206 to the support 205 is larger at positions closer to end portions 402*a* and 402*b* than a central portion 401 of a sheet conveyance width in the longitudinal direction of the reflector 206 or the support 205. FIG. 4A is a plan view of the fixing device having a configuration in which the flow rate of the heat from the reflector 206 to the support 205 is increased at positions closer to the end portions than the central portion. FIGS. 4B and 4C are graphs of distributions of the amount of heat conduction from the reflector 206 to the support 205 during operation of the fixing belt 121. In FIG. 4B, it can be seen that values on the left side of the graph are larger since the amount of heat conduction is larger at the end portion 402*a* than at the central portion 401. In FIG. 4C, it can be seen that values on the right side of the graph are larger since the amount of heat conduction is larger at the end portion 402*b* than at the central portion 401. As described above, contacting the reflector 206 and the support 205 at the longitudinal end portions increases the amount of heat conduction on the end portion sides.

Figure 5A:
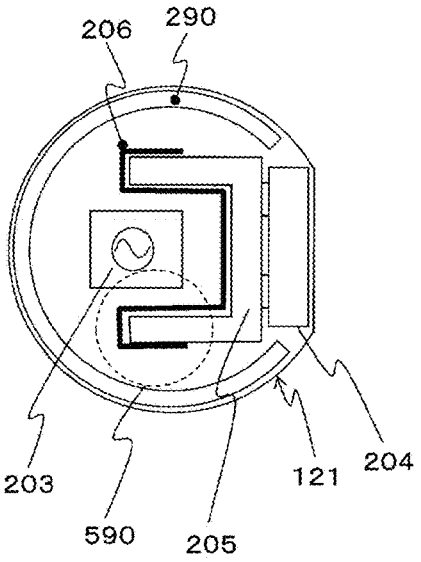
FIG. 5Aa is a cross-sectional view of a configuration of the fixing device in which the reflector and the support are in contact with each other at at least one end portion and are not in contact with at least a part of the central portion.
Figure 5A:
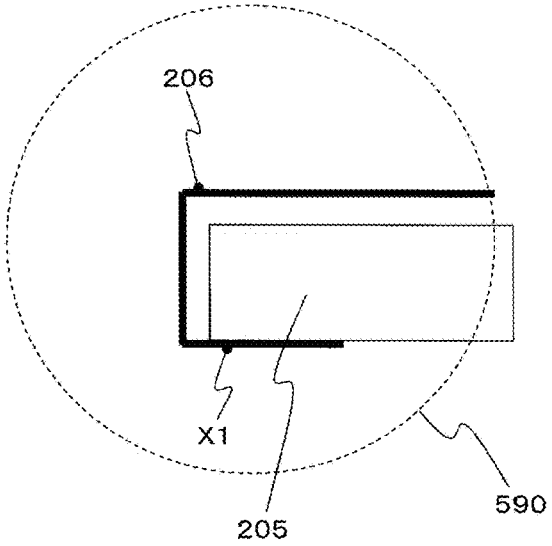
Figure 5A:
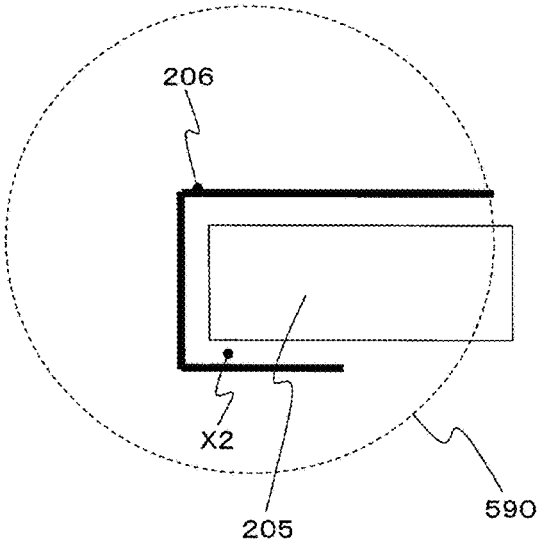
Figure 5B:
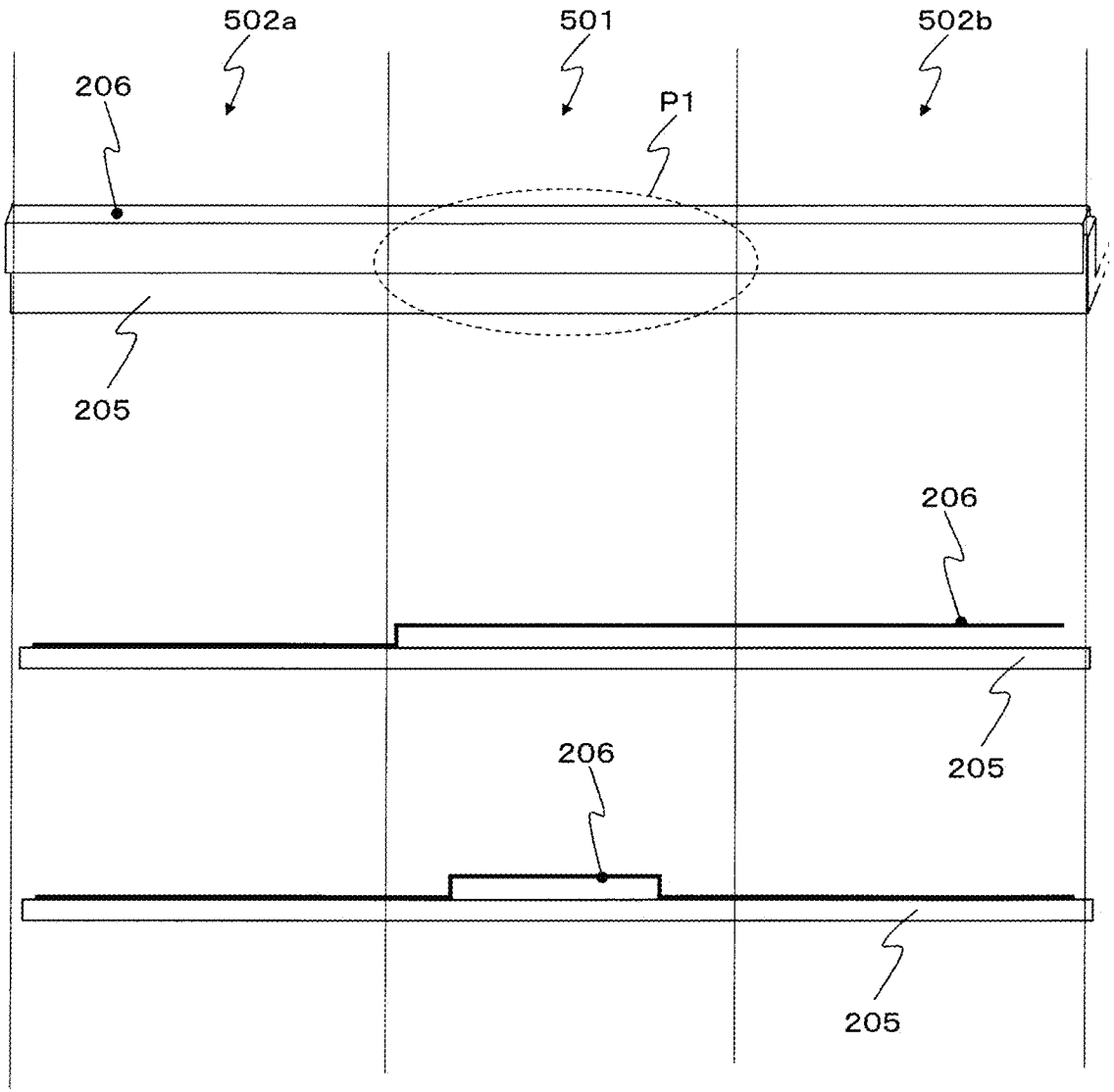
FIG. 5B is a plan view of the fixing device illustrated in FIG. 5Aa, illustrating an arrangement relationship between the reflector and the support.

FIGS. 5Aa, 5Ab, 5Ac, and 5B are diagrams of a configuration in which the reflector 206 and the support 205 are in contact with each other at at least one end portion and are not in contact with at least a part of the central portion. FIG. 5Aa is a cross-sectional view of the fixing device in this configuration and FIGS. 5Ab and 5Ac are enlarged views of the fixing device of FIG. 5Aa. FIG. 5B includes part (a) that is a top view of the fixing device illustrated in FIG. 5Aa and parts (B) and (C) that are diagrams of an arrangement relationship between the reflector 206 and the support 205. As illustrated in FIG. 5Ab, in a certain area 590 of the reflector 206 and the support 205 (a lower arm portion of a U shape of the support 205 in FIG. 5Aa), the fixing device 200 of the present configuration includes a portion X1 at which the reflector 206 and the support 205 contact with each other and are secured by screwing or the like. As illustrated in FIG. 5Ac, the fixing device 200 of this configuration includes a portion X2 in which the reflector 206 and the support 205 are not in contact with each other and a gap is provided between the reflector 206 and the support 205.

As illustrated in part (a) of FIG. 5B, the portion X1 and the portion X2 are formed such that the reflector 206 and the support 205 are not in contact with each other, like the portion X2, in the longitudinal central portion 501 of the reflector 206 or the support 205. That is, all or at least a part of the central portion 501 has a region P1 including a gap such as the portion X2.

For example, as illustrated in part (b) of FIG. 5B, in one of the left end portion 502*a* and the right end portion 502*b* of the central portion 501 (the left end portion 502*a* in part (b) of FIG. 5B), the reflector 206 and the support 205 are secured in contact with each other as in the portion X1. In the other end portion (the right end portion 502*h* in part (b) of FIG. 5B) and the central portion 501, the reflector 206 and the support 205 are not in contact with each other as in the portion X2. For example, as illustrated in part (C) of FIG. 5B, in both the left end portion 502*a* and the right end portion 502*b* are secured in contact with each other as in the portion X1. In the central portion 501, the left end portion 502*a* and the right end portion 502*b* are in non-contact with each other as in the portion X2.

As described above, the reflector 206 and the support 205 are in contact with each other at at least one end portion in the longitudinal direction and are not in contact with each other in the central portion in the longitudinal direction. The distribution of the amount of heat conduction from the reflector 206 to the support 205 can be changed by changing the contact position between the reflector 206 and the support 205, thus increasing the amount of heat conduction on at least one end portion in the longitudinal direction. Contacting the reflector 206 and the support 205 directly can increase the heat conduction, without an additional member, than when the reflector 206 and the support 205 are not in contact with each other. Accordingly, the distribution of heat conduction amount as illustrated in FIG. 4 can be easily achieved.

Figure 6A:
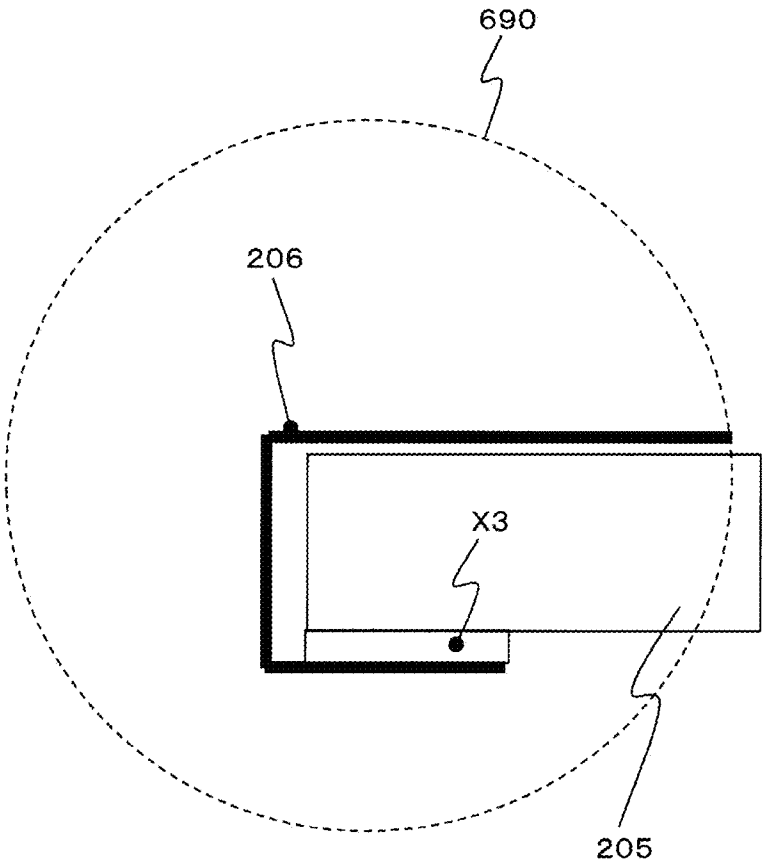
FIG. 6Aa is a cross-sectional view of a configuration the fixing device in which the reflector and the support are in contact with each other via a heat insulator on a secured surface.
Figure 6A:
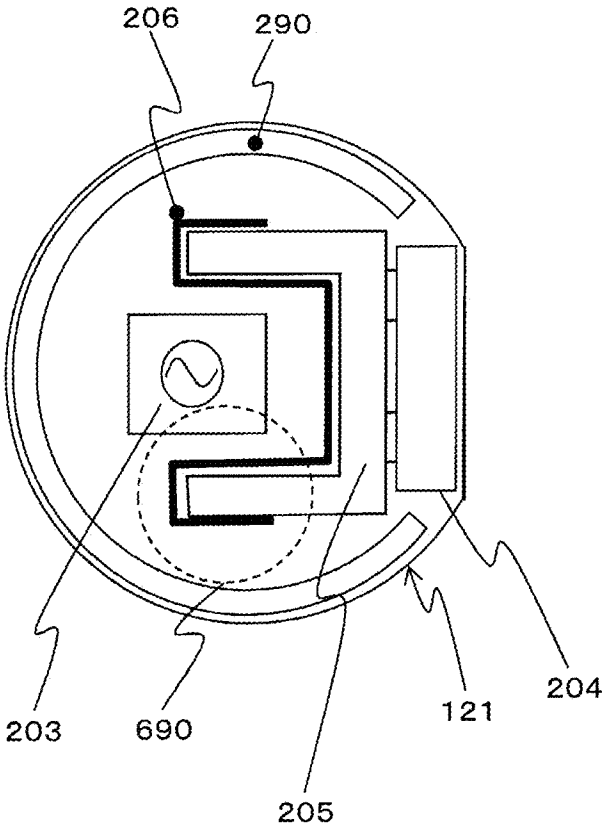
Figure 6B:
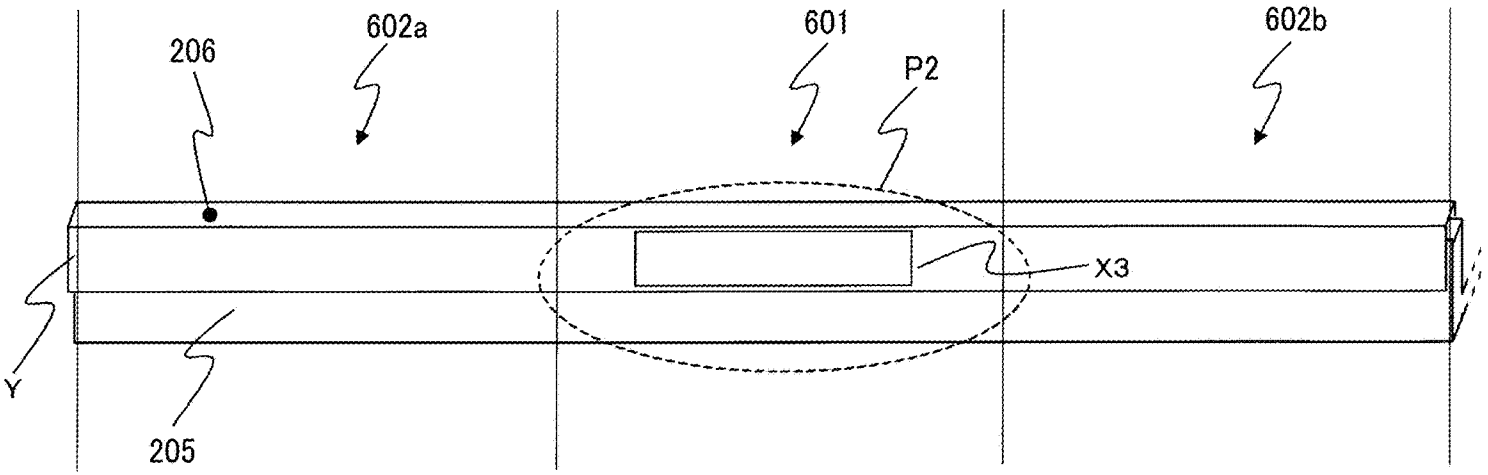
FIG. 6Ba is a plan view of the fixing device illustrated in FIG. 6Aa, illustrating an arrangement relationship between the reflector and the support.
Figure 6B:
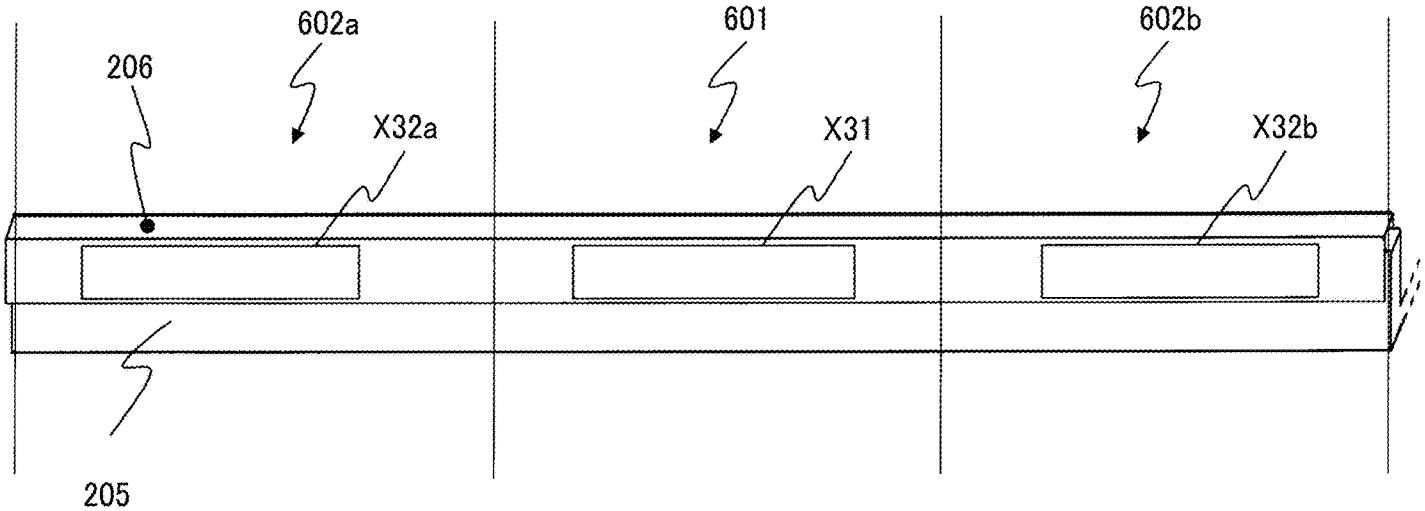

FIGS. 6Aa, 6Ab, 6Ba, and 6Bb are diagrams of a configuration in which the reflector 206 and the support 205 are in contact with each other on a secured surface Y via a heat insulator X3. FIG. 6Aa is a cross-sectional view of the fixing device in this configuration. FIG. 6Ab is an enlarged view of the fixing device illustrated in FIG. 6Aa. FIG. 6Ba is a plan view of the fixing device illustrated in FIG. 6Aa. FIG. 6Bb is a diagram of an arrangement relationship between the reflector 206 and the support 205. In a certain area 690 of the reflector 206 and the support 205 (a lower arm portion of the U-shaped support 205 in FIG. 6Aa), as illustrated in FIG. 6Ab, the fixing device 200 of the present configuration includes a portion in which the reflector 206 and the support 205 contact with each other via, for example, a heat insulator X3 and are secured by screwing or the like.

For the above-described portion, as illustrated in of FIG. 6Ba, the heat insulator X3 is sandwiched by the reflector 206 and the support 205 all or at least a part of the central portion 601 in a central portion 601 in the longitudinal direction of the reflector 206 or the support 205. The heat insulator X3 is not provided in both end portions 602*a* and 602*b* of the central portion 601. FIG. 6Ba illustrates the case where the heat insulator X3 is not provided at both end portions 602*a* and 602*b*, As illustrated in part (b) of FIG. 5B, one of the end portions may not be provided with the heat insulator X3.

Further, for example, as illustrated in FIG. 6Bb, a heat insulator X31 having a low thermal conductivity is disposed in the central portion 601. Heat insulators X32*a* and X32*b* having a higher thermal conductivity than the heat insulator X31 are disposed in the left end portion 602*a* and the right end portion 602*b*. FIG. 6Bb illustrates the case where the heat insulators having a higher thermal conductivity than the central portion are disposed at both end portions. As illustrated in (b) of FIG. 5B, the above-described heat insulator having a higher thermal conductivity than the central portion may be disposed in one of the end portions.

As described above, in at least a part of the central portion in the longitudinal direction, the reflector 206 and the support 205 are in contact with each other via the heat insulator. In at least a part of the central portion in which the reflector 206 and the support 205 are in contact with each other, the heat insulator is sandwiched between the reflector 206 and the support 205. Such a configuration can increase the amount of heat conduction on an end portion side in the longitudinal direction by a method different from the method illustrated in FIGS. 5Aa to 5B, thus reducing the heat transfer in the central portion. That is, the heat conduction generated from the central portion of the contact portion between the reflector 206 and the support 205 can be reduced, thus reducing the amount of heat conduction from the central portion to the end portion.

To secure the reflector 206, the reflector 206 and the support 205 are brought into contact with each other at least to some extent. To achieve the shape of the reflector 206 with a simple configuration, the central portion 601, the end portion 602*a*, and the end portion 602*b* are preferably formed by one plane. In such a case, on the secured surface Y, the reflector 206 and the support 205 contact with each other with a uniform force at the central portion 601 and the end portions 602*a* and 602*b*, and the amount of heat conduction is also uniform. Accordingly, assuming such a case, a heat insulator having a high thermal conductivity is sandwiched in at least one end portion, thus reducing the amount of heat transfer from the central portion.

Further, interposing a member between the reflector 206 and the support 205 and selecting a combination of materials of the member can easily create a difference in the amount of heat conduction between the central portion and the end portion.

Figure 7A:
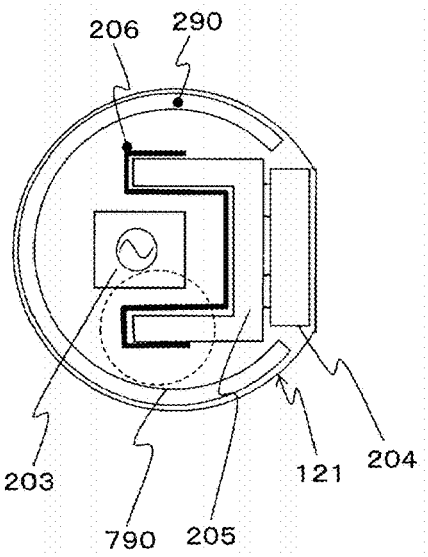
FIG. 7Aa is a cross-sectional view of another configuration of the fixing device in which the reflector and the support are in contact with each other at at least one end portion and are not in contact with at least a part of the central portion.
Figure 7A:
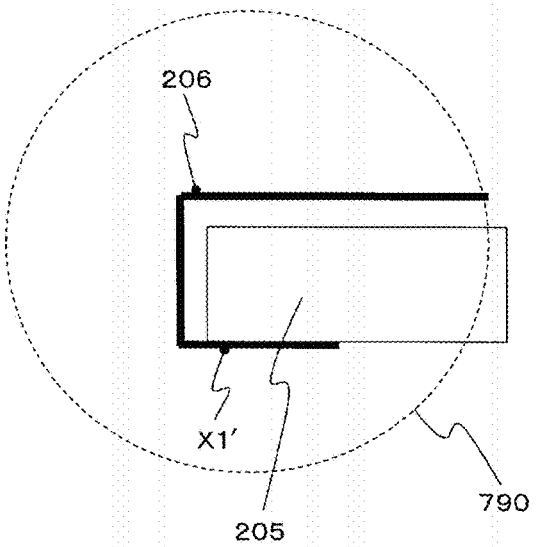
Figure 7A:
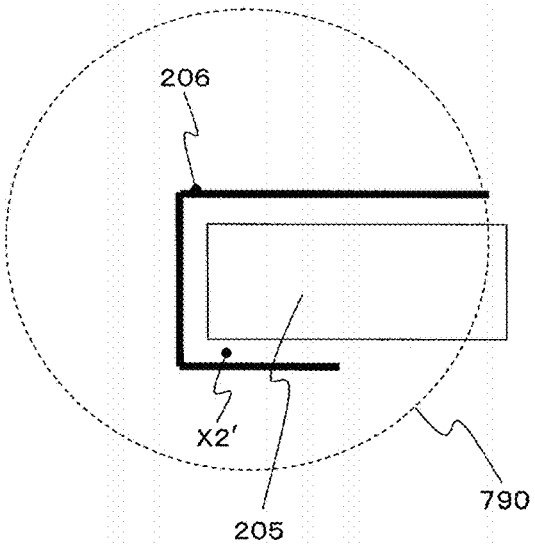
Figure 7B:
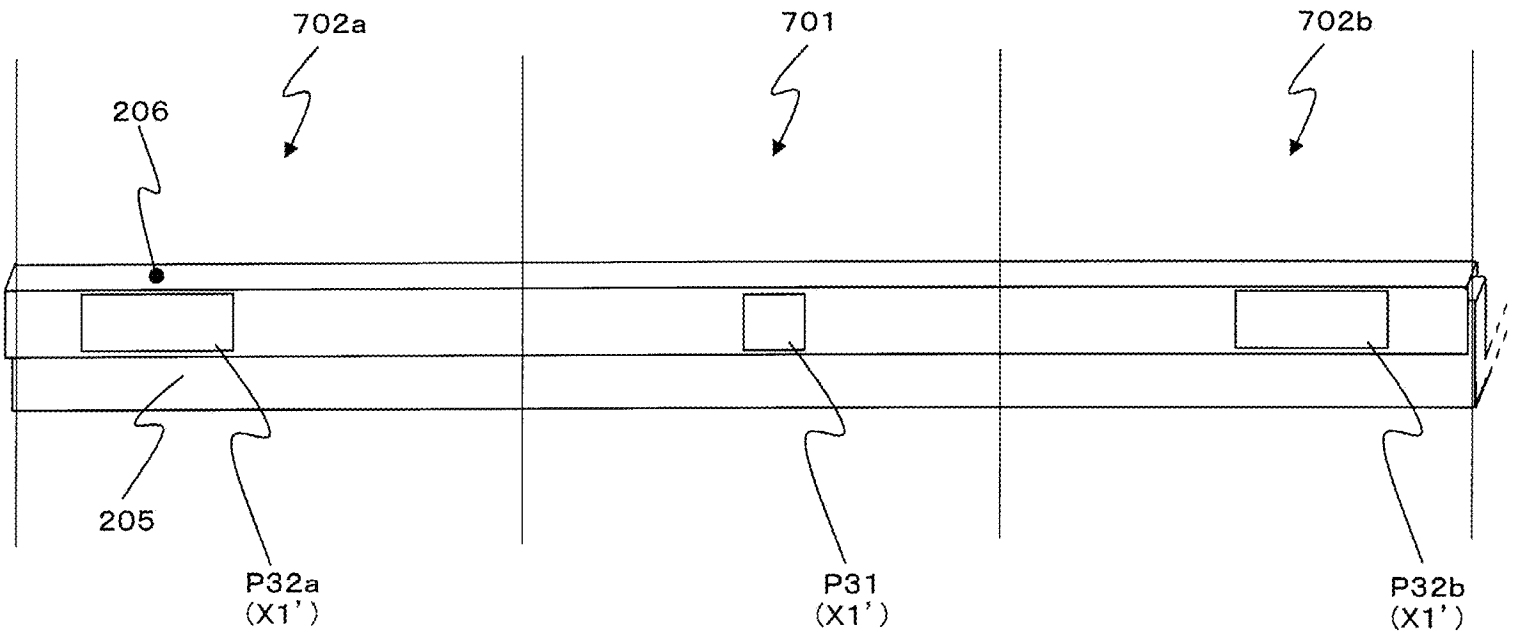
FIG. 7B is a plan view of the fixing device illustrated in FIG. 7Aa, illustrating an arrangement relationship between the reflector and the support.

FIGS. 7Aa, 7Ab, 7Ac, and 7B are diagrams of another configuration in which the reflector 206 and the support 205 are in contact with each other at at least one end portion and are not in contact with at least a part of the central portion. FIG. 7Aa is a cross-sectional view of the fixing device in this configuration. FIGS. 7Ab and 7Ac are enlarged views of the fixing device illustrated in FIG. 7Aa. FIG. 7B is a plan view of the fixing device illustrated in FIG. 7Aa, illustrating an arrangement relationship between the reflector 206 and the support 205.

As illustrated in FIG. 7Ab, in a certain area 790 of the reflector 206 and the support 205 (a lower arm portion of a U shape of the support 205 in FIG. 7Aa), the fixing device 200 of the present configuration includes a portion X1' in which the reflector 206 and the support 205 contact with each other and are secured by screwing or the like. As illustrated in FIG. 7Ac, the fixing device 200 of this configuration includes a portion X2' in which the reflector 206 and the support 205 are not in contact with each other and a gap is provided between the reflector 206 and the support 205.

For the portion X1' and the portion X2', as illustrated in FIG. 7B, the reflector 206 and the support 205 contact each other and are secured in a contact region P31, which is a part of a central portion 701, and contact regions P32*a* and P32*b*, which are parts or all of end portions 702*a* and 702*b*, respectively, in the longitudinal direction of the reflector 206 or the support 205, like the portion X1'. That is, the contact region P31 in the central portion 701 has a smaller contact area than each of the contact regions P32*a* and P32*b* at both end portions. FIG. 7B illustrates the case where the contact region in the central portion has a smaller area than the contact region at each end portion. Alternatively, as illustrated in part (b) of FIG. 5B, a configuration may be employed in which the contact region in the central portion has a smaller area than the contact region at one of the end portions. Thus, the area of the contact region where the reflector 206 and the support 205 are in contact with each other is larger at the end portion in the longitudinal direction than at the central portion in the longitudinal direction. The distribution of the amount of heat conduction from the reflector 206 to the support 205 can be changed by changing the contact area between the reflector 206 and the support 205, thus increasing the amount of heat conduction on the end portion side in the longitudinal direction. In addition, even if it is necessary to contact the reflector 206 and the support 205 at the central portion, such as when it is necessary to secure the reflector 206 and the support 205 at the central portion and both end portions, changing the contact area between the central portion and the end portion can easily create a difference in the amount of heat conduction between the central portion and the end portion.

FIGS. 7Aa, 7Ab, 7Ac, and 7B illustrate the case where the shape of the reflector 206 is changed to change the contact area. As illustrated in FIGS. 6Aa to 6Bb, a member (for example, a heat insulator) that more easily conducts heat than the support 205 are interposed between the reflector 206 and the support 205 to form the contact region.

Figure 8A:
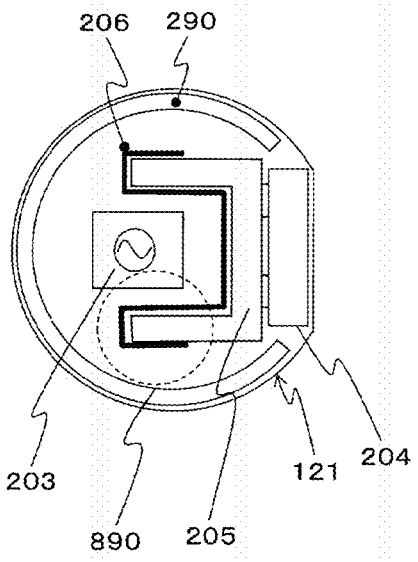
FIG. 8Aa is a cross-sectional view of still another configuration of the fixing device in which the reflector and the support are in contact with each other at at least one end portion and are not in contact with at least a part of the central portion.
Figure 8A:
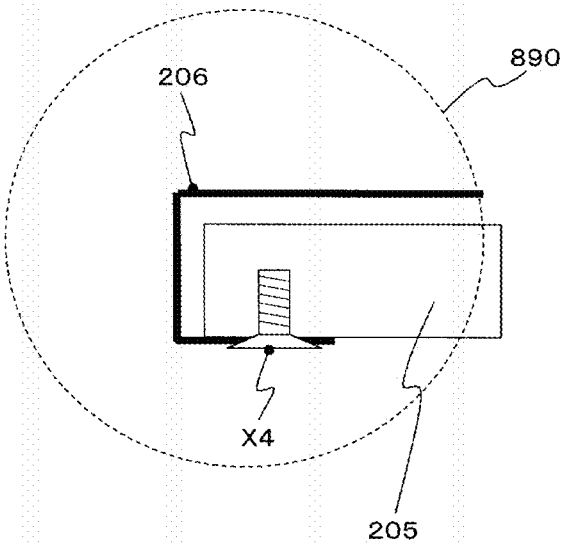
Figure 8A:
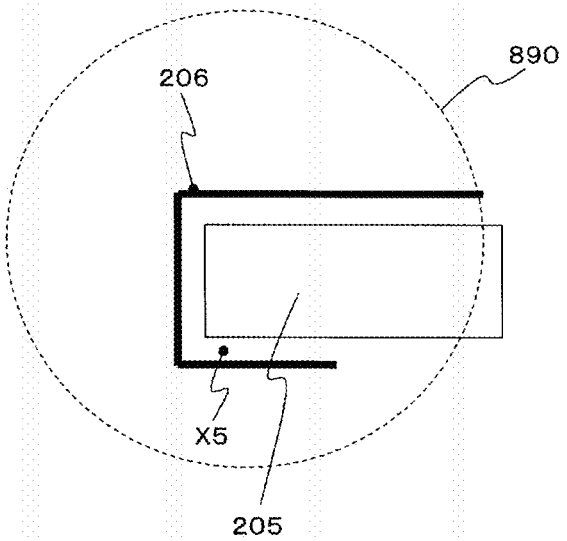
Figure 8B:
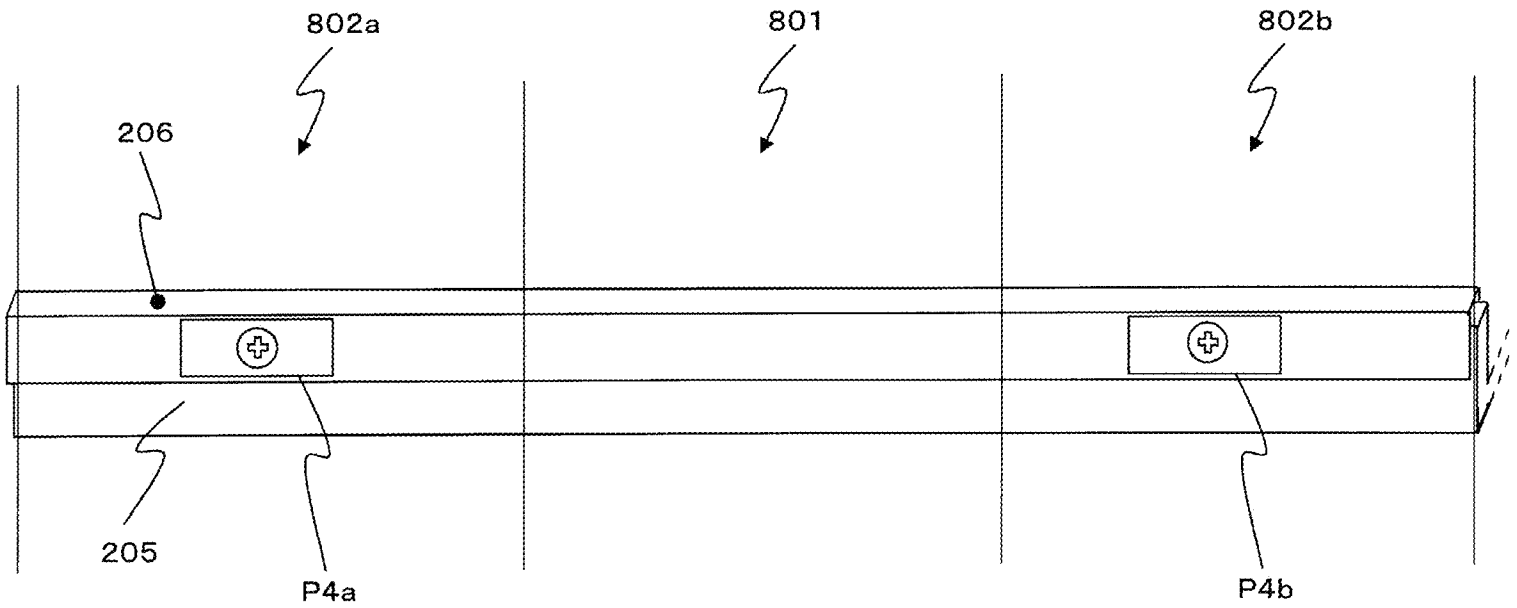
FIG. 8B is a plan view of the fixing device illustrated in FIG. 8Aa, illustrating an arrangement relationship between the reflector and the support.

FIGS. 8Aa, 8Ab, 8Ac, and 8B are diagrams of still another configuration in which the reflector 206 and the support 205 are in contact with each other at at least one end portion and are not in contact with at least a part of the central portion. FIG. 8Aa is a cross-sectional view of the fixing device in this configuration. FIGS. 8Ab and 8Ab are enlarged views of the fixing device illustrated in FIG. 8Aa. FIG. 8B is a plan view of the fixing device illustrated in FIG. 8Aa, illustrating an arrangement relationship between the reflector 206 and the support 205.

As illustrated in FIG. 8Ab, in a certain area 890 of the reflector 206 and the support 205 (a lower arm portion of a U shape of the support 205 in FIG. 8Aa), the fixing device 200 of this configuration includes a portion X4 in which the reflector 206 and the support 205 contact with each other and are secured by screwing or the like at one or more positions. As illustrated in FIG. 8Ac, the fixing device 200 of this configuration includes a portion X5 in which the reflector 206 and the support 205 are not in contact with each other and a gap is provided between the reflector 206 and the support 205.

For the portion X4 and the portion X5, as illustrated in FIG. 8B, the reflector 206 and the support 205 are not secured in a region of a central portion 801 in the longitudinal direction of the reflector 206 or the support 205 and are not in contact with each other like the portion X5 illustrated in FIG. 8Ac. Like the portion X4 illustrated in FIG. 8Ab, the reflector 206 and the support 205 contact with each other and are secured in regions P4*a* and P4*b*, which are parts or all of end portions 802*a* and 802*b* in the longitudinal direction of the reflector 206 and the support 205. That is, the central portion 801 is a non-contact region, and the end portions 802*a* and 802*b* have contact regions. FIG. 8B illustrates the case where the reflector 206 and the support 205 are screwed at one point in each of the contact regions P4*a* and P4*b*. Alternatively, the reflector 206 and the support 205 may be screwed at two or more points according to the sizes of the contact regions P4*a* and P4*b*. That is, the point to be screwed may be determined according to the area of the contact region where the reflector 206 and the support 205 contact with each other. For example, when the contact areas P4*a* and P4*b* extend over the entire regions of the end portions 802*a* and 802*b*, the number of screwing points in each of the contact areas P4*a* and P4*b* may be two. Such a configuration can reliably increase the amount of heat conduction on the end portion side in the longitudinal direction even when the contact region is relatively large.

As described above, conventionally, heat that cannot be reflected by a reflector may accumulate in a longitudinal central portion of a fixing unit and raise the temperature, which may exceed the heat resistance temperature of a component. As described above, fascinating the reflector and the support at axial end portions can increase the amount of heat conduction on the end portion, reduce the rise in the temperature of the reflector, and enhance the productivity. That is, the reflector and the support (securing member) are secured so as to increase the contact area at a longitudinal end portion(s) where heat does not easily accumulate. Such a configuration can efficiently release the heat of the reflector itself and reduce the temperature of the reflector.

Embodiments of the present disclosure are not limited to the above-described embodiments, and in an implementation stage, the above-described components may be modified and embodied without departing from the scope of the invention, or a plurality of components disclosed in the above-described embodiments may be implemented in appropriate combination.

The invention claimed is:

1. A fixing device comprising:

a fixing rotator;

a heat source configured to heat the fixing rotator;

a pressing member configured to form a nip with the fixing rotator; and a nip formation member, disposed inside a loop of the fixing rotator and opposed to the pressing member, to form the nip between the fixing rotator and the pressing member;

a reflector configured to reflect heat from the heat source; and a support, in a U-shape, configured to secure the reflector, an arm of the U-shape of the support being in contact with the reflector at one end portion in a longitudinal direction of the support.

2. The fixing device according to claim 1, wherein the support is in secured to the reflector in both end portions in the longitudinal direction of the support.

3. The fixing device according to claim 2, wherein an area of a contact region of the support with the reflector is relatively larger in the at least one end portion of the support in the longitudinal direction than in a central portion of the support in the longitudinal direction.

4. An image forming apparatus comprising the fixing device according to claim 2.

5. The fixing device according to claim 1, further comprising a heat insulator interposed between the support and the reflector in at least a part of a central portion in the longitudinal direction of the support.

6. The fixing device according to claim 1, wherein an area of a contact region of the support with the reflector is relatively larger in the at least one end portion of the support in the longitudinal direction than in a central portion of the support in the longitudinal direction.

7. The fixing device according to claim 1, wherein the reflector is secured to the support by screwing.

8. The fixing device according to claim 7, wherein the reflector is screwed to the support at a portion determined according to an area of a contact region of the support with the reflector.

9. An image forming apparatus comprising the fixing device according to claim 1.

10. The fixing device according to claim 1, further comprising a heat insulator interposed between the support and the reflector in at least a part of a central portion in the longitudinal direction of the support.

11. The fixing device according to claim 1, wherein the nip formation member is made of a resin.

12. The fixing device according to claim 11, wherein the reflector is screwed to the support at a portion determined according to an area of a contact region of the support with the reflector.

13. A fixing device comprising:

a fixing rotator;

a heat source configured to heat the fixing rotator;

a pressing member configured to form a nip with the fixing rotator; and a nip formation member, disposed inside a loop of the fixing rotator and opposed to the pressing member, to form the nip between the fixing rotator and the pressing member;

a reflector configured to reflect heat from the heat source; and a support configured to secure the reflector, the support being secured to the reflector at one end portion in a longitudinal direction of the support, and remaining unsecured in a central portion in a longitudinal direction of the support.

14. The fixing device according to claim 13, wherein the support is in secured to the reflector in both end portions in the longitudinal direction of the support.

15. The fixing device according to claim 13, further comprising:

a heat insulator interposed between the support and the reflector in at least a part of a central portion in the longitudinal direction of the support.

16. The fixing device according to claim 13, wherein an area of a contact region of the support with the reflector is relatively larger in the at least one end portion of the support in the longitudinal direction than in a central portion of the support in the longitudinal direction.

17. An image forming apparatus comprising the fixing device according to claim 13.

18. The fixing device according to claim 13, wherein the reflector is screwed to the support at a portion determined according to an area of a contact region of the support with the reflector.

19. The fixing device according to claim 13, wherein the support is in a U-shape, configured to secure the reflector, and an arm of the U-shape of the support being in contact with the reflector at one end portion in a longitudinal direction of the support.

20. The fixing device according to claim 19, wherein the nip formation member is made of a resin.

* * * * *